US007077095B2

(12) United States Patent
Hada et al.

(10) Patent No.: US 7,077,095 B2
(45) Date of Patent: Jul. 18, 2006

(54) CYLINDER BLOCK STRUCTURE

(75) Inventors: Masatoshi Hada, Nagoya (JP); Satoshi Murata, Yokohama (JP); Naoyuki Satou, Akishima (JP)

(73) Assignees: Aichi Kikai Kogyo Kabushiki Kaisha, Aichi-Ken (JP); Nissan Motor Co., Ltd., Yokohama (JP)

( * ) Notice: Subject to any disclaimer, the term of this patent is extended or adjusted under 35 U.S.C. 154(b) by 73 days.

(21) Appl. No.: 10/961,393

(22) Filed: Oct. 12, 2004

(65) Prior Publication Data

US 2005/0076876 A1 Apr. 14, 2005

(30) Foreign Application Priority Data

Oct. 10, 2003 (JP) ..... 2003-352843

(51) Int. Cl.
*F02F 7/00* (2006.01)

(52) U.S. Cl. ..... 123/195 H

(58) Field of Classification Search ..... 123/195 H, 123/193.2, 195 R, 41.74, 195 HC, 195 A, 123/195 C; 29/888.06
See application file for complete search history.

(56) References Cited

U.S. PATENT DOCUMENTS 5,009,205 A * 4/1991 Abe et al. ..... 123/195 H
5,247,915 A 9/1993 Sasada et al.
2002/0062795 A1 5/2002 Ioue et al.

FOREIGN PATENT DOCUMENTS

| | | |
|---|---|---|
| DE | 10218354 | 11/2003 |
| JP | 02102351 | 4/1990 |
| JP | 04017760 | 1/1992 |
| JP | 10205389 | 8/1998 |
| JP | 2000045863 | 2/2000 |

* cited by examiner

*Primary Examiner*—Henry C. Yuen
*Assistant Examiner*—Hyder Ali

(57) ABSTRACT

A cylinder block structure with a small number of ribs is provided which can favorably prevent the deformation of a crankshaft bearing portion. In a cylinder block having bolt holes formed on the upper surface for connecting a cylinder head with bolts, arcshaped coupling surfaces formed on the rear end surface for mounting a housing, such as a transmission housing, and a crankshaft bearing portion formed in the central part between the lower ends of the coupling surfaces, the upper parts of the coupling surfaces 5 are joined into an arch-shape by an arch-shaped rib, the lower ends of right and left bosses are extended and connected to the lower parts of the arch-shaped rib, and right and left main radial ribs extend from the outside of the lower end of the bolt hole boss to the center of the crankshaft bearing portion.

2 Claims, 3 Drawing Sheets

CYLINDER BLOCK STRUCTURE

FIELD OF THE INVENTION

The present invention relates to a structure of a cylinder block and more particularly to a structure of a cylinder block rear end on which a housing, such as a transmission housing, may be mounted.

BACKGROUND OF THE INVENTION

In a case of the prior art, as disclosed in the following patent document, a number of ribs are formed in vertical and radial directions in the region of a joining surface at the rear end of a cylinder block on which a transmission case is mounted.

Unexamined Patent Publication No. H10-205389

In the above-described current structure where a number of ribs are formed in vertical and radial directions, there have been problems that the weight of the whole cylinder block increases and that the casting operation of the cylinder block cannot be efficiently performed.

In views of the above-described problems of the prior art, it is an object of the present invention to provide a cylinder block that can minimize the number of ribs, thereby ensuring a lightweight construction and improving castability.

According to an aspect of the present invention, there is provided a cylinder block having bolt holes formed on the upper surface for connecting a cylinder head with bolts, arc-shaped coupling surfaces formed on the rear end surface for mounting housings of a transmission and the like, and a crankshaft bearing portion formed in the central part between the lower ends of the coupling surfaces, the improvement of the structure of the cylinder block, comprising: an arch-shaped rib joining the upper parts of the coupling surfaces into an arch-shape; right and left bolt hole bosses having bolt holes formed therein; the lower ends of the right and left bolt hole bosses extended and connected to the lower parts of the arch-shaped rib; and right and left main radial ribs respectively extended from the outside of the lower end of the right and left bolt hole bosses to the center of the crankshaft bearing portion.

According to the present invention, the upper parts of the coupling surface at the rear end of the cylinder block are joined by the arch-shaped rib into an arch-shape; the lower ends of the right and left bolt hole bosses having bolt holes formed therein extend to the lower parts of the arch-shaped rib and are joined to the arch-like rib; and the right and left main radial ribs extend from outside of the lower ends of the right and left bolt hole bosses toward the center of the crankshaft bearing portion. Therefore, when the cylinder head is coupled onto the cylinder block with bolts, although a force may act to generate a falling deformation of the bolt hole boss, the cylinder block is pulled up to the side of the cylinder head and the tightening force of the bolt is dispersed excellently in the directions of the arch-shaped rib and main radial rib. Thus, the deformations of the cylinder and crank bearing portion are minimized, so that the roundness of the crank bearing portion is secured, thereby eliminating seizure of the crank bearing portion, sealing failure and so on.

According to another aspect of the present invention, a top face lateral rib is formed in the lateral direction above the arch-shaped rib and right and left vertical ribs which connect both right and left ends of the top face lateral rib to the coupling surfaces and arch-shaped rib is formed outside the right and left bolt hole bosses.

Because the top face lateral rib is formed in the lateral direction above the arch-shaped rib and right and left vertical ribs which connect both right and left ends of the top face lateral rib to the coupling surface, and because the arch-shaped rib is formed outside the right and left bolt hole bosses, fall of the bolt hole boss due to the tightening force of the bolt can be suppressed and further, the deformation of the crank bearing portion can be suppressed excellently.

According to a further aspect of the present invention, a horizontal reinforcement rib for connecting the right and left main radial ribs is provided.

Because the horizontal reinforcement rib for connecting the right and left main radial ribs is provided, stiffness of the right and left main radial ribs is enhanced by the horizontal reinforcement rib, so that the number of the ribs on the cylinder head rear end surface can be minimized, thereby securing light weight cylinder head having an excellent castability.

DESCRIPTION OF THE PREFERRED EMBODIMENTS

Hereinafter, the preferred embodiments of the present invention will be described with reference to the accompanying drawings.

Figure 1:
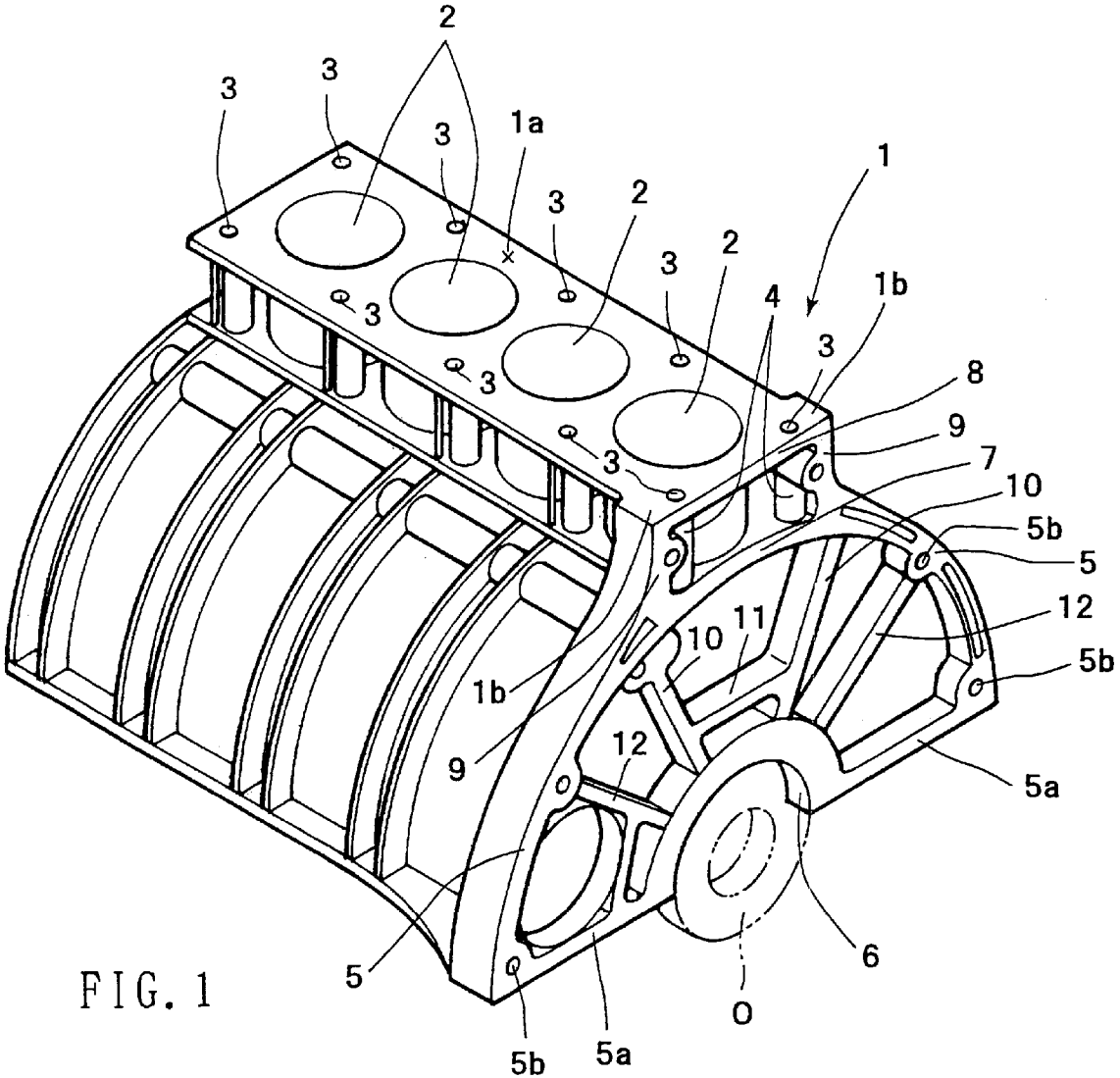
FIG. 1 is a perspective view of a cylinder block.
Figure 2:
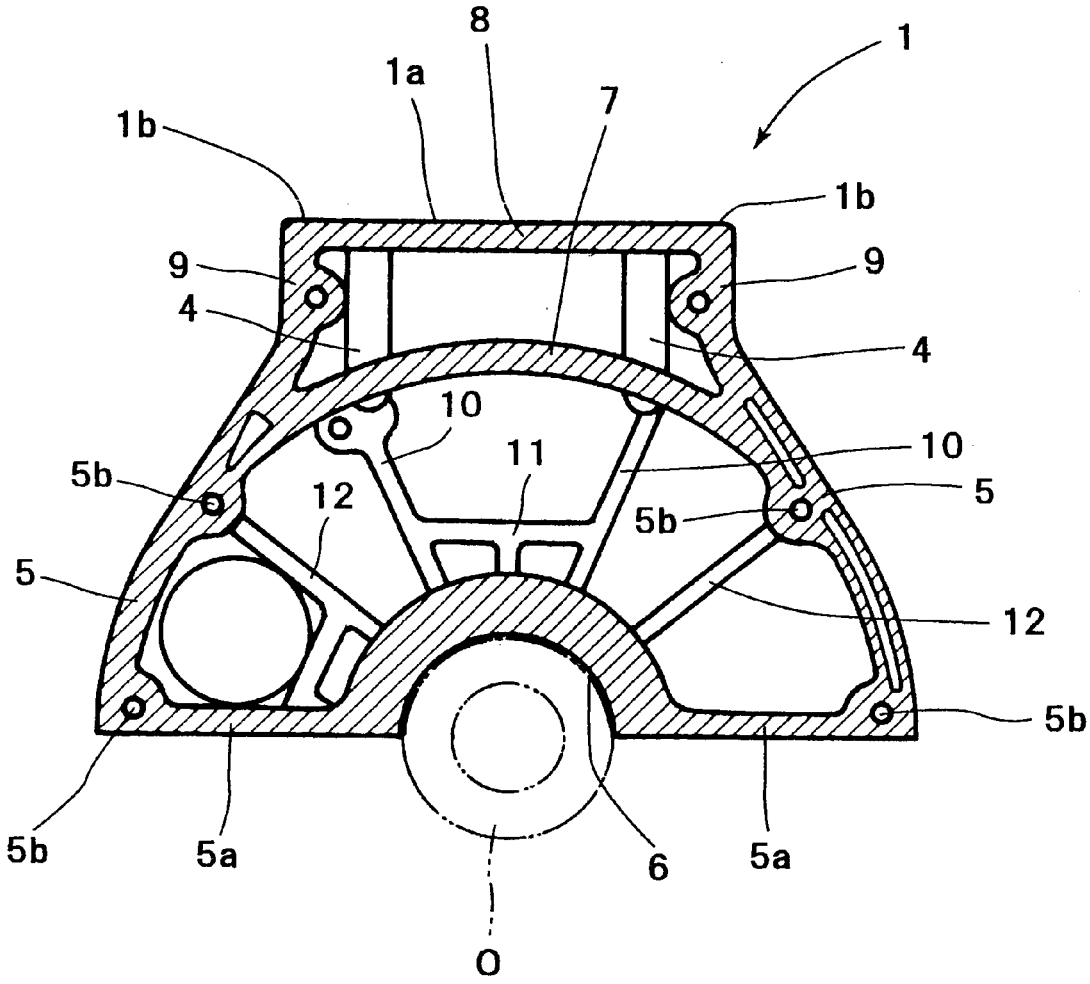
FIG. 2 is a side view of the rear end portion of the cylinder block.

FIG. 1 is a perspective view of the cylinder block and FIG. 2 is a side view of the rear end portion of the cylinder block.

A cylinder head mounting face 1*a* on which the cylinder head is to be mounted is formed on the upper surface of the cylinder block 1. Four cylinder bores 2 are formed in the cylinder block 1 to extend vertically such that they are open at the upper surface of the cylinder block 1. A plurality of bolt holes 3 are formed at intervals in the cylinder block 1 and are positioned outside of the cylinder bores.

Bolts are inserted from above into bolt holes 3 and are tightened, so that the cylinder head is mounted on the upper surface.

Right/left flange-shaped reinforcement portions 1*b* extending outward are formed integrally with both right and left sides of the rear end of the cylinder head mounting face 1*a*. A top face lateral rib 8 which connects the right and left flange-shaped reinforcement portions 1*b* in a lateral direction is formed integrally with the rear end portion of the upper surface of the cylinder block 1 such that it is substantially horizontal.

Right and left vertical ribs 9 are formed on the rear end surface so that they droop downward from both the right and left ends of the top face lateral ribs 8 and coupling surfaces 5 are formed continuously in the right and left directions such that they are curved from the lower ends of the right and left vertical ribs 9 outward in the shape of an arc. The upper parts of the right and left coupling surfaces 5 are joined into an arch-shape by an arch-shaped rib 7 and the lower ends of the right and left vertical ribs 9 are integrated with the right and left ends of the arch-shaped rib 7 so that they are continuously formed.

The lower end portions of the right and left coupling surfaces 5 are formed as a horizontal bottom face rib 5*a* and a semi-circular crankshaft bearing portion 6 is formed integrally upward in the center of the bottom face ribs 5*a*.

An oil seal O is attached to the crankshaft bearing portion 6 so that it is interleaved between the crankshaft bearing portion and an oil pan (not shown).

A plurality of housing mounting holes 5*b* are formed in the coupling surfaces 5 and a mechanical transmission housing, an automatic transmission housing and the like are mounted on the coupling surface 5.

Right and left bolt hole bosses 4 formed on the side of the rear end surface and each having the bolt hole 3 formed therein are formed inside the right and left vertical ribs 9, so that they extend from the side of the top face lateral rib 8 downward to the lower side of the arch-shaped rib 7 and the lower ends of the right and left bolt hole bosses 4 are joined to the arch-shaped rib 7.

Right and left main radial ribs 10 are provided integrally such that they extend from outside of the lower ends of the right and left bolt hole bosses 4 toward the center of the crankshaft bearing portion 6. These right and left main radial ribs 10 are connected to each other with a horizontal reinforcement rib 11 on their lower parts so as to be reinforced.

Below the right and left main radial ribs 10, radial-shaped auxiliary radial ribs 12 are formed so as to connect the right and left coupling surfaces 5 with the crankshaft bearing portion 6.

As described above, a plurality of ribs in the vertical and lateral directions are not provided on the rear end surface of the cylinder block 1 unlike the conventional cylinder block and this cylinder block is reinforced with the right and left main radial ribs 10, the auxiliary radial ribs 12, the arch-shaped rib 7, the right and left vertical ribs 9 and the top face lateral rib 8 while the number of the used ribs is smaller than the conventional case, thereby leading to reduction of weight.

Figure 3:
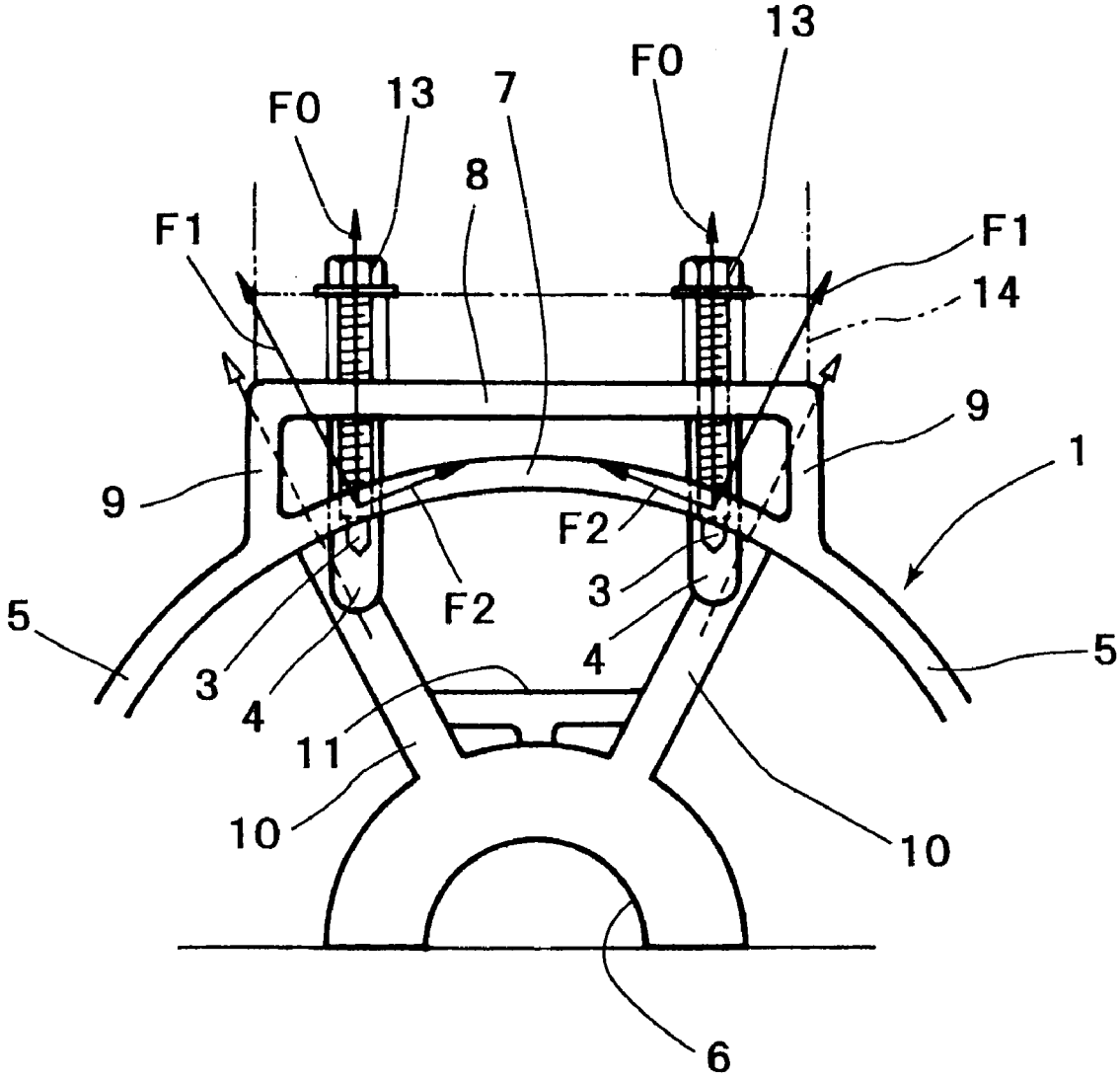
FIG. 3 is an explanatory diagram showing the dispersion of the tightening force of the bolts.

When the cylinder head 14 is mounted on the cylinder head mounting face 1*a* of the cylinder block 1 as shown in FIG. 3, the bolts 13 are tightened within each bolt hole 3. The tightening force of this bolt 13 needs to be large enough for winning against a combustion explosive force within the cylinder bores 2. Due to this large tightening force, falling deformation of the bolts 13 occurs in the conventional cylinder block, thereby causing deformations of the cylinder bores 2 and the crankshaft bearing portion 6. In this example, the tightening force F0 of the bolts 13 is dispersed to a force F1 in the direction of the right and left main radial ribs 10 directed to the center of the crankshaft bearing portion 6 and a force F2 in the direction of the arch of the arch-shaped rib 7, so as to suppress the deformations of the cylinder bore 2 and the crankshaft bearing portion 6 to a minimum extent.

That is, the roundness of the crankshaft bearing portion 6 is secured and seizure of the crankshaft bearing portion 6 and generation of sealing failure can be eliminated.

What is claimed is:

1. A cylinder block having bolt holes formed on the upper surface for connecting a cylinder head with bolts, arch-shaped coupling surfaces formed on the rear end surface for mounting a housing, and a crankshaft bearing portion formed in the central part between the lower ends of said coupling surfaces, the cylinder block comprising:

an arch-shaped rib joining upper parts of said coupling surfaces into an arch-shape;

right and left bosses having bolt holes formed therein and having lower ends extending to lower parts of said arch-shaped rib so as to be connected thereto;

right and left main radial ribs extending from the outside of the lower end ends of said bosses to the center of said crankshaft bearing portions;

a top face lateral rib formed to extend in a lateral direction above said arch-shaped rib; and right and left vertical ribs connecting both right and left ends of the face lateral rib to said coupling surface and arch-shaped rib formed outside said right and left bolt hole bosses.

2. The cylinder block structure according to claim 1, further including a horizontal reinforcement rib for connecting the right and left main radial ribs.

* * * * *